US011590631B2

(12) United States Patent
Fenley, Jr.

(10) Patent No.: US 11,590,631 B2
(45) Date of Patent: Feb. 28, 2023

(54) WET ABRASIVE BLAST MACHINE WITH REMOTE CONTROL RINSE CYCLE

(71) Applicant: Clean Blast Systems, LLC

(72) Inventor: Jerry L. Fenley, Jr., Gonzales, LA (US)

( * ) Notice: Subject to any disclaimer, the term of this patent is extended or adjusted under 35 U.S.C. 154(b) by 768 days.

(21) Appl. No.: 16/540,798

(22) Filed: Aug. 14, 2019

(65) Prior Publication Data

US 2021/0046609 A1 Feb. 18, 2021

(51) Int. Cl.
*B24C 7/00* (2006.01)
*B24C 3/06* (2006.01)

(52) U.S. Cl.
CPC ..... *B24C 7/0015* (2013.01); *B24C 7/0038* (2013.01); *B24C 3/06* (2013.01)

(58) Field of Classification Search
CPC ..... B24C 7/0015; B24C 7/0038
USPC ..... 451/91, 90
See application file for complete search history.

(56) References Cited

U.S. PATENT DOCUMENTS 1,966,571 A 7/1934 Webb
2,387,193 A 10/1945 Swenarton
2,667,015 A 1/1954 Berg
3,256,642 A * 6/1966 Fonti ..... B24C 5/02 451/90
3,380,658 A * 4/1968 Stasz ..... B60S 3/044 134/40
3,447,272 A 6/1969 Eppler
3,455,062 A 7/1969 Eppler
3,543,444 A * 12/1970 Mehta ..... B24C 7/00 451/101
3,994,097 A 11/1976 Lamb
4,044,507 A 8/1977 Cox et al.
4,330,968 A 5/1982 Kobayashi et al.
4,646,480 A 3/1987 Williams
4,951,428 A 8/1990 Strömdahl
5,065,551 A 11/1991 Fraser
5,112,406 A 5/1992 Lajoie et al.
5,123,206 A 6/1992 Woodson
5,509,971 A 4/1996 Kirschner
5,545,074 A 8/1996 Jacobs
5,575,705 A 11/1996 Yam et al.
(Continued)

OTHER PUBLICATIONS

Brochure published by Robson Jul. 27, 2011: https://www.slideshare.net/narobson/n-a-robson-brochure and submitted as a PDF herewith.

*Primary Examiner* — Christopher W Fulton
(74) *Attorney, Agent, or Firm* — Williams Intellectual Property; Benjamin F. Williams

(57) ABSTRACT

An improved wet abrasive blast machine with remote control rinse cycle enables a pilot operating the apparatus to control remote switching between blast and rinse cycles directly, for example from a nozzle of a blast hose or from a panel. A first and second hydraulic circuit and a pneumatic circuit are controllable via communication with a control circuit which is operable remotely to direct a configurable pilot signal between various valve states. In a preferred embodiment, the control circuit is powered pneumatically via a branch circuit fed from the pneumatic circuit. Switching between to configurations is effected by directing an air pilot signal between airflows interior to a series of valves. In an alternate embodiment switching airflows between configurations is effected electrically.

14 Claims, 12 Drawing Sheets

(56) References Cited

U.S. PATENT DOCUMENTS

| | | | | |
|---|---|---|---|---|
| 5,827,114 | A | 10/1998 | Yam et al. | |
| 6,280,301 | B1 | 8/2001 | Rogmark | |
| 6,354,327 | B1 * | 3/2002 | Mayhew | F16K 37/0041 91/32 |
| 6,413,923 | B2 | 7/2002 | Honda et al. | |
| 6,609,955 | B1 | 8/2003 | Farrow | |
| 6,905,396 | B1 | 6/2005 | Miller et al. | |
| 8,465,262 | B2 * | 6/2013 | Stiles, Jr. | F04B 49/20 417/326 |
| D773,542 | S | 12/2016 | Nash | |
| 9,844,851 | B2 * | 12/2017 | Lecompte | B24C 7/0038 |
| 9,925,642 | B2 | 3/2018 | Eliason | |
| 10,245,702 | B2 * | 4/2019 | McIntyre | F04B 49/225 |
| 10,471,570 | B2 * | 11/2019 | Trull, Jr. | B24C 3/06 |
| 10,537,979 | B2 * | 1/2020 | Skross | B24C 7/0076 |
| 10,610,998 | B2 * | 4/2020 | Nash | B24C 7/0084 |
| 11,260,503 | B2 * | 3/2022 | Hashish | B24C 3/04 |
| 2005/0105001 | A1 | 5/2005 | Yui et al. | |
| 2012/0015592 | A1 | 1/2012 | Eliason | |
| 2013/0324016 | A1 | 12/2013 | Eliason | |
| 2017/0334036 | A1 | 11/2017 | Turner et al. | |
| 2019/0275640 | A1 * | 9/2019 | McKenna | B24C 7/0084 |
| 2020/0094377 | A1 * | 3/2020 | Turner | B24C 7/0084 |

* cited by examiner

WET ABRASIVE BLAST MACHINE WITH REMOTE CONTROL RINSE CYCLE

BACKGROUND OF THE INVENTION

Various wet abrasive blast machines and vapor blast machines (collectively "WAB" machines) are well known in the surface cleaning industry. Typically, a hydraulic side and a pneumatic side combine to enable blasting of pressurized fluids to scour and clean surfaces. A blast pot, containing grit, is pressurized by water pumped from a standalone water tank into the blast pot to maintain a pressure therein. Pneumatic pressure is thence generated via an air compressor into a blast hose via a piping manifold connected to the blast pot by a slurry hose. Slurry (grit and water) from the blast pot is thence introduced into the airflow in the blast hose to jet a spray of pressurized fluid containing grit against a targeted surface. The effect is to spray a high velocity stream of grit particles to scour and clean the targeted surface. Depending on the grit used and the pressures employed, the surface may be scoured to remove paint, rust, residue, chemicals, oxides, and other surface elements or contaminants, to expose, restore, or refinish the surface.

During blasting operations, introduction of grit from the blast pot into the airstream is controlled by a pinch valve operating at the juncture of the slurry hose and the blast hose. When an operator enacts a switch at the blast hose nozzle, typically a deadman switch to require active engagement, the pinch valve is automatically opened to release pressure on the hydraulic side whereby slurry is forced into the airstream and thence carried, at pressure, for blasting.

As seen in the art, water from the standalone tank is also applied to a rinse cycle after blasting operations have ceased. The present state of the art controls application of rinse water by requiring manual shut-off of a ball valve disposed upon the slurry hose whereby water is introducible into the airstream while the slurry from the blast pot is excluded. This presents several problems and inefficiencies when blasting. First, a second operator is generally required to tend the blast pot and respond to signals from the operator to disengage the hydraulic side for rinsing to commence. Slurry remnant in the slurry hose downstream from the ball valve, and up to the blast hose nozzle, must then be evacuated by the rinse stream before rinsing operations can properly commence. This results in wasted time, resources, wear on the ball valve, and additional manpower—especially when switching between blasting and rinsing operations frequently since the ball valve must be manually set each time between blasting and rinsing and the slurry in the slurry hose downstream from the ball valve and in the blast hose must be evacuated.

What is needed is a control circuit feeding back to the pinch valve from the blast hose proper wherein the operator of the blast hose is enabled remote control of a pinch to switch between blasting and rinsing operations without having to employ use of the upstream ball valve in sealing off the blast pot, nor deactivate the pumps pressurizing the hydraulic circuit(s), nor deactivating the compressor(s) pressurizing the pneumatic circuit. Thus, singlehanded blasting operations are enabled and immediate switching between rinse and blasting cycles is effectuated more efficiently with the hydraulic and pneumatic circuits maintained at pressure.

FIELD OF THE INVENTION

The present invention relates to an improved wet abrasive blast machine with remote control rinse cycle, and more particularly, to an improved wet abrasive blast machine with remote control rinse cycle that includes a control circuit enabling remote control of blasting and rinsing operations. The control circuit directs a pilot air signal, drawn off the pneumatic circuit and fed between various configurations, to control a main blast air inlet valve, a rinse solenoid valve, a pinch air block valve, and a pinch valve whereby an operator, and a pilot at the blast hose nozzle, are enabled to remotely control introduction of slurry into the blast stream and immediately switch between, and cease, blasting and rinse cycles.

SUMMARY OF THE INVENTION

The present improved wet abrasive blast machine with remote control rinse cycle has been devised to enable an operator to switch between blast and rinse cycles remotely and at the nozzle of the blast hose. The present improved wet abrasive blast machine obviates the need for a second party (or other party) to control introduction and exclusion of slurry from the blast hose, instead enabling a single user or pilot operating the blast nozzle to control immediate cycling between blasting and rinsing.

Wet abrasive blasting (also known as "vapor blasting") is established and well known in the art. Insoluble grit particles, typically sand-sized silicates and/or other grits, are delivered from a blast pot by a pressurized non-compressible fluid (typically water) pumped into the blast pot. The fluid acts as a carrier, displacing the grit from the blast pot as a slurry into a slurry hose for communication to a blast hose wherein an airstream sprays the slurry forth at pressure to clean and scour surfaces. Rinsing is enabled by shutting off the slurry hose to prevent slurry from entering the blast hose while pumping water bypassing the blast pot for dispersal via the airstream.

Wet abrasive blasting, therefore, employs at least three circuits—two hydraulic circuits and a pneumatic circuit. Switching between rinsing and blasting is typically accomplished in tandem—a user operating the blast hose at the point of operations (known as a "pilot" in the art) is typically distally disposed relative the blast pot, which may be large and heavy. A second operator, therefore, is required to manually engage at least one valve upon the slurry hose to prevent slurry from entering the blast hose during rinse cycles. Employment of the second party for such purposes increases costs associated with wet abrasive blasting and causes delays to accommodate communication back and forth between the pilot and the said second party.

Further, the valve employed in switching between blast and rinse cycles is typically the slurry hose shut-off valve, a ball valve that operates to seal off the slurry hose interiorly and wholly throttle the circuit. Blasting ejects coarse grit particles which rapidly wear and degrade such components that contact the slurry stream. Use of the ball valve to disable blasting and enable rinsing is therefore an inefficient use of an expensive part. Present day, slurry hose shut-off valves employed in this fashion are one of the most frequently replaced parts in the surface cleaning industry. Operation of a pinch valve to close of the slurry hose in a guillotine-like enclosure prevents direct wear on the valve. Since the interior of the slurry hose is smooth and disposed along the direction of flow, wear is significantly lessened and the hose itself considerably less expensive to replace anyway.

The sheer quantity of fluid and slurry used in wet abrasive blasting necessitates large vessels for storage of the water supply and for pressurizing the slurry. Such large vessels restrict a range of motion whereby operations are predominantly limited by the length of the blast hose proper. Surface cleaning requires ambulation by the pilot to cover the targeted area, which may include vertical and other non-horizonal surfaces requiring elevation of the pilot (such as, for example, when cleaning the interior of hulls of large ocean-faring vessels). As presently seen in the art, the pilot typically communicates with a second party to switch between blast and rinse cycles at the slurry shut-off valve and also, oftentimes, with a third party who tends the water supply, grit supply, and acts to control the air-compressor required to maintain the airstream in the pneumatic circuit. Often, disabling the pneumatic circuit is effectuated by turning off the compressor, thereby throttling the pneumatic circuit and blast and rinse cycles and requiring reboot and a time lapse while pressure is restored in the system.

The present invention, therefore, addresses and obviates these and other inefficiencies, enabling switching between the rinse and blast cycles remotely and, in a preferred embodiment, directly from the nozzle of the blast hose by a pilot actively engaging in surface cleaning operations. The pilot, therefore, need not arrest blasting or rinsing and await receipt of an all clear signal, but can control action between each of a first and second hydraulic circuit by action of a control circuit that, in a preferred embodiment set forth herein, operates via configuration of an air pilot signal directed within a branch circuit fed by the pneumatic circuit and controllable by a series of manual controls located remotely and at the nozzle of the blast hose.

An alternate embodiment is set forth herein that also contemplates an electrically operated control circuit by effecting electric switching of the various valves to direct the air pilot signal between controlling branch circuits, as will be described subsequently.

In the preferred embodiment set forth herein, such switching of various valves to direct the air pilot signal between controlling branch circuits is also controlled pneumatically, by the same air pilot signal. It should be understood by persons of ordinary skill in the art that such discussion of the preferred embodiment is entered herein to engender clarity in exemplifying a singular configuration of the present invention, with particular and specific examples by way of explanation, and that variations of parts and arrangements of parts informing the following disclosure are determined and contemplated to be within scope of the inventive step set forth herein where consistent with the overall motivation and intent exemplified and described.

Discussing now the preferred embodiment, then, air is drawn off the pneumatic circuit upstream of a main blast air inlet valve to feed the control circuit. The air is routed at approximately 100 psig through an instrument air filter-regulator that regulates air pressure and removes moisture and any particulates. The control circuit is thus operable pneumatically, by a pilot signal of air pressure ("air pilot signal" and, when contemplating electrical alternatives, just "pilot signal") maintained and cycled within the control circuit during blast and rinse operations and fed directly from the pneumatic circuit. (It is noted that alternative pressures are contemplated for operating the invention, and may be employed while practicing the invention. The range cited herein is not meant to be limiting. A pressure differential merely need be maintained between each of the first and second hydraulic circuits and the pneumatic circuit to ensure introduction of slurry (or water) into the blast airstream.)

A deadman remote control handle is disposed at the blast hose nozzle to enable manipulation of the pilot signal, to actuate valve actuators that effectively switch between the blast and rinse cycles, and to disable blasting if released. The deadman remote control handle is a normally-closed, two-way, manually operable pneumatic block valve that receives a control pressure signal from an upstream deadman supply air regulator via a twin line remote control tubing that connects the control circuit with the blast nozzle.

A main control valve-relay is disposed in the control circuit and functions as the main on-off control for the blast air cycle. The main control valve-relay is a pneumatic five-port, four-way, pneumatic air pilot controlled valve with one normally-closed and one normally-open port. When the deadman remote control handle is squeezed by a pilot operating the blast hose nozzle, air is routed through a branch circuit via an emergency stop valve to an actuator upon the main control valve-relay. Pressurization by airflow incident this actuator causes the main control valve-relay to actuate and switch airflow from a normally-open port to a normally-closed port, thereby enabling the blast cycle, as will be described subsequently.

Airflow through the normally-closed port of the main control valve-relay sends a pilot signal to a branch circuit that controls the main blast air inlet valve (to activate airflow through the pneumatic circuit) and concurrently instates a pilot signal at a normally-closed port of a rinse control valve-relay. When this normally-closed port of the rinse control valve-relay is closed, the air pilot signal thereat is preempted.

Airflow introduced into the control circuit is likewise fed in parallel into the rinse control valve-relay from the air filter-regulator. During blast operations, airflow is directed through a normally-open port inside the rinse control valve-relay. Airflow through the normally-open port of the rinse control valve-relay is directed to actuate a pinch air block valve disposed in fluid communication with the main control valve-relay and the pinch valve operative upon the slurry hose. When actuated, the pinch air block valve opens. When the pinch air block valve is open and airflow through the main control valve-relay is active through the normally-closed port therein, airflow is exhausted through a pinch valve exhaust to depressurize the branch circuit controlling the pinch valve, thereby ensuring the pinch valve is open whereby the first hydraulic circuit is enabled. Thus, blasting operations are enabled when the deadman remote control handle is squeezed (or activated).

The rinse control valve-relay is actuated by a pilot signal diverted thereto by action of a remote rinse control valve disposed at the blast hose nozzle (the remote rinse control valve may of course be remotely located as well). Manual action at the remote rinse control valve diverts airflow into a branch circuit to pressurize an actuator actuating the rinse control valve-relay to switch airflow through the rinse control valve-relay normally-closed port. When the normally-closed port of the rinse control valve-relay is opened by the pilot signal sent from a remote rinse control valve, airflow pressurizes a branch circuit controlling a rinse water solenoid valve that enables waterflow through the second hydraulic circuit. Concurrently, airflow is preempted from the pinch air block valve by closure of the normally-open valve in the rinse control valve-relay, preventing airflow therethrough, which thence causes closure of the pinch air block valve and prevention of exhaust from the pinch valve control circuit. The pinch valve is thus pressurized and actuates to cease the first hydraulic circuit by clamping the slurry hose. The rinse cycle is now enabled.

Switching between blast and rinse cycles is effective immediately by an operator or pilot switching the remote rinse control valve. Pressure potential at both the first and second hydraulic circuits is uninterrupted. Pressure within the pneumatic circuit is uninterrupted. Only throughflow is ceased or enabled, thereby enabling immediate switching between blast and rinsing cycles.

Release of the deadman remote control handle ceases blast operations—the main control valve-relay switches airflow to the normally-open port whereby the pinch valve is immediately actuated to cease throughflow of the first hydraulic circuit and airflow is not fed via the normally-closed port to actuate the main blast air inlet valve thereby disabling the pneumatic circuit.

Thus has been broadly outlined the more important features of the present improved wet abrasive blast machine with remote control rinse cycle so that the detailed description thereof that follows may be better understood and in order that the present contribution to the art may be better appreciated.

Objects of the present improved wet abrasive blast machine with remote control rinse cycle, along with various novel features that characterize the invention are particularly pointed out in the claims forming a part of this disclosure. For better understanding of the improved wet abrasive blast machine with remote control rinse cycle, its operating advantages and specific objects attained by its uses, refer to the accompanying drawings and description.

BRIEF DESCRIPTION OF THE DRAWINGS

Figures

Figure 1:
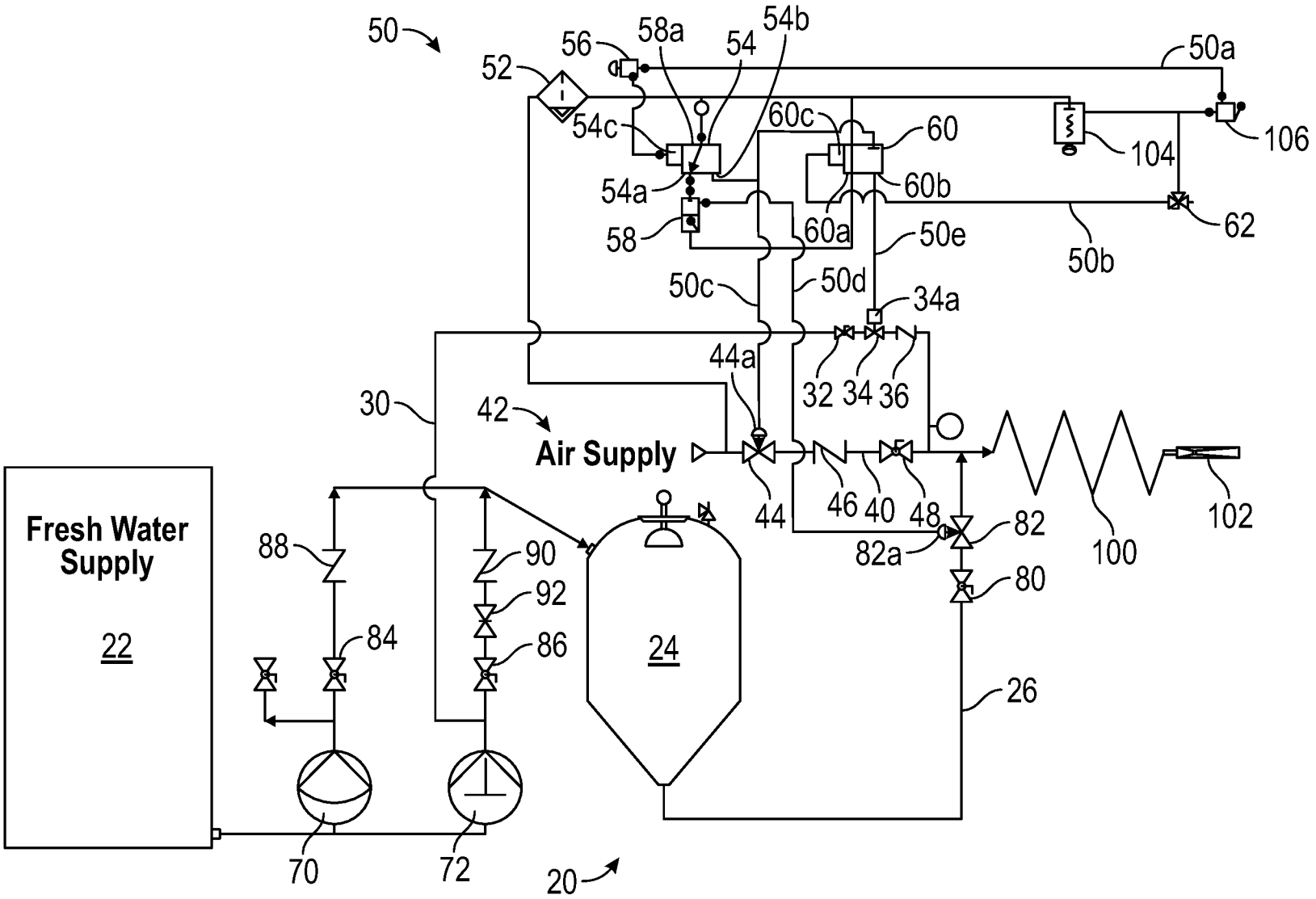
FIG. 1 is a schematic view of a preferred embodiment utilizing a pneumatic control circuit.

| Parts List | |
|---|---|
| 10 | Improve wet abrasive blast machine |
| 20 | first hydraulic circuit |
| 22 | fresh water supply |
| 24 | blast pot |
| 26 | slurry hose |
| 30 | second hydraulic circuit |
| 32 | rinse shut-off valve |
| 34 | rinse water solenoid valve |
| 34a | actuator |
| 36 | rinse water check valve |
| 40 | pneumatic circuit |

-continued

| Parts List | |
|---|---|
| 42 | compressor |
| 44 | main blast air inlet valve |
| 44a | actuator |
| 46 | main air check valve |
| 48 | blast pressure throttling valve |
| 50 | control circuit |
| 50a | branch circuit (deadman North) |
| 50b | branch circuit (deadman south) |
| 50c | branch circuit (main blast air inlet valve) |
| 50d | branch circuit (pinch valve) |
| 50e | branch circuit (rinse water solenoid valve) |
| 52 | air filter-regulator |
| 54 | main control valve-relay |
| 54a | normally-open port |
| 54b | normally-closed port |
| 54c | actuator |
| 56 | emergency stop valve |
| 58 | pinch air block valve |
| 58a | pinch air block valve exhaust |
| 58b | pinch air block actuator |
| 60 | rinse control valve-relay |
| 60a | normally-open port |
| 60b | normally-closed port |
| 60c | actuator |
| 62 | remote rinse control valve |
| 70 | double diaphragm fill pump |
| 72 | piston blast pump |
| 80 | slurry hose shut-off valve |
| 82 | slurry hose pinch valve |
| 82a | actuator |
| 84 | fill pump shut-off valve |
| 86 | blast pump shut-off valve |
| 88 | fill pump check valve |
| 90 | blast pump check valve |
| 92 | grit metering valve |
| 100 | blast hose |
| 102 | nozzle |
| 104 | deadman regulator |
| 106 | deadman remote control handle |
| 500 | inlet panel |
| 502 | connection port to main blast air inlet valve |
| 504 | fill line |
| 506 | blast inlet pressure gauge |
| 508 | dump valve |
| 509 | air dump valve |
| 510 | utility line |
| 511 | cleanout aperture |
| 512 | faucet |
| 514 | outlet panel |
| 516 | blast hose attachment aperture |
| 518a | pneumatic control line port: rinse signal |
| 518b | pneumatic control line port: supply air |
| 518c | pneumatic control line port: return air |
| 520a | control line: rinse |
| 520b | control line: supply |
| 520c | control line: return |
| 522 | blast pressure gauge |
| 524 | hopper pressure gauge |
| 526 | emergency stop button |
| 528 | control (grit metering valve) |
| 530 | blast pump switch |
| 532 | control circuit air inlet tubing |
| 534 | remote rinse control valve switch |
| 600 | frame member |
| 602 | funnel top member |
| 604 | top aperture |
| 606 | seating stopper |
| 608 | raised top plate |

DETAILED DESCRIPTION OF THE DRAWINGS

With reference now to the drawings, and in particular FIGS. 1 through 11 thereof, example of the instant improved wet abrasive blast machine with remote control rinse cycle employing the principles and concepts of the present improved wet abrasive blast machine with remote control rinse cycle and generally designated by the reference number 10 will be described.

Referring to FIGS. 1 through 11, a preferred embodiment of the present improved wet abrasive blast machine with remote control rinse cycle 10 is illustrated.

A schematic of the present wet abrasive blast machine with remote control rinse cycle 10 is depicted in FIG. 1. A prime difference between the depicted preferred embodiment and wet abrasive blast machines known in the art is use of a control circuit 50 to enable switching between the blast and rinse cycles controllable by a pilot operating the device remotely, or by a pilot engaging blast and rinse operations at a nozzle 102 of a blast hose 100. The present invention 10 enables the pilot to access clean water by bypassing blast pot 24 to engage the rinse cycle without having to rely on a second person to disable throughflow via the blast pot 24, typically by manually operating a pinch valve 82 or shut-off valve 80 to disable the slurry hose 26 upstream of the blast hose 100 junction, as is currently seen practiced in the art.

The present improved wet abrasive blast machine with remote control rinse cycle 10, therefore, includes a first hydraulic curcuit 20 that directs waterflow from fresh water supply 22 to blast pot 24, slurry hose 26, and blast hose 100. The first hydraulic circuit 20 therefore routes waterflow from fresh water supply 22 into blast pot 24 by action of air-operated double diaphragm fill pump 70 and piston blast pump 72. Water entered into blast pot 24 is therefore subjected to pressure by action of pumps 70, 72 and serves to displace and convey grit particles storable interior blast pot 24 into slurry hose 26 for dispersal into an airstream generated interior to blast hose 100 by action of a pneumatic circuit 40, as will be described subsequently. Pressure of approximately 125 to 150 psig is attained throughout the first hydraulic circuit 20. High pressure fluid containing grit and water, or "slurry", is thus dispersible ejected from the nozzle 102 of the blast hose 100 to scour and clean surfaces, as is seen in the present state of the art. It is noted that alternative pressures are contemplated for operating the invention, and may be employed while practicing the invention. The range cited herein is not meant to be limiting. A pressure differential merely need be maintained between each of the first and second hydraulic circuits and the pneumatic circuit to ensure introduction of slurry (or water) into the blast airstream.

Introduction of slurry from slurry hose 26 into the high-pressure airstream, which is maintained in blast hose 100 by action of the pneumatic circuit 50, is controllable by operation of slurry hose shut-off valve 80—an isolation valve operating a full port ball valve disposed upstream of the conjunction between slurry hose 26 and blast hose 100. In the present state of the art, this shut-off valve 80 is typically operated manually to disable throughflow of slurry into the blast hose 100 thereby to arrest grit application and scouring operations. Thus, when the slurry hose shut-off valve 80 is actuated to a closed position, the first hydraulic curcuit 20 is arrested and slurry is ceased from introduction into the blast hose 100 until the slurry shut-off valve 80 is actuated to an open position. Slurry shut-off valve 80 is therefore a throttle, disabling the first hydraulic curcuit 20 until opened manually.

In the present invention 10, however, a pinch valve 82, disposed downstream of slurry hose shut-off valve 80 but still upstream of blast hose 100, operates a sliding guillotine-style valve to compress the slurry hose 26 and pinch-off throughflow of slurry therethrough. Activation and deactivation of the first hydraulic curcuit 20 is thus controllable by action of pinch valve 82, particularly when switching between blast and rinse cycles, as will be described subsequently. Pinch valve 82 is disposed in operational communication with the control circuit 50, as will be described subsequently, and is thus operable remotely by a user piloting the apparatus 10 at a distally located panel or by the pilot controlling blast operations at the nozzle 102 of the blast hose 100.

A second hydraulic circuit 30 is disposed connecting waterflow from fresh water supply 22 to blast hose 100 without the blast pot 24 or the slurry hose 26, thereby bypassing the grit contained in the blast pot 24 altogether. This second hydraulic circuit 30 therefore delivers waterflow to blast hose 100 by an alternate route bypassing blast pot 24 and slurry hose 26 to introduce water into the pressurized airstream maintained in blast hose 100 by action of the pneumatic circuit 40 when active. Water is drawn from fresh water supply 22 immediately downstream of piston blast pump 72, and forced through rinse shut-off valve 32, a throttle; rinse water solenoid valve 34, controllable via the control circuit; and rinse water check valve 36, to prevent backflow; and into blast hose 100.

Rinse water shut-off valve 32 is an instrument ball valve disposed to throttle water supply into the second hydraulic circuit 30 when necessary. Rinse water solenoid valve 34 is an air actuated solenoid valve disposed to control throughflow of water branched into the second hydraulic circuit 30 by action of piston blast pump 72. The rinse water solenoid valve 34 engages when a pilot air signal is received at actuator 34*a* from the control circuit 50, fed via a normally-closed port 60*b* disposed upon rinse control valve-relay 60 operative in the control circuit 50, as will be described subsequently.

High-pressure ejection of water from the blast hose 100 nozzle 102 absent grit particles is therefore enabled for use in a rinse cycle. Throughflow of water bypassing blast pot 24 is thus controllable via control of the rinse water solenoid valve 34. Peculiar to this invention 10, switching between blast cycles and rinse cycles is enabled remotely, even directly from the nozzle 102 of the blast hose 100, by action of a control circuit 50, as will be described subsequently, while maintaining active operation of pumps 70, 72 and, as discussed below, compressor 42.

The pneumatic circuit 40 is configured to control throughflow of pressurized air through the blast hose 100. Air is introduced into the pneumatic circuit 40 by action of compressor 42 and is passed to blast hose 100 through main blast air inlet valve 44, main air check valve 46, and blast pressure throttling valve 48. The main blast air inlet valve 44 includes an air activated solenoid to control actuating and de-actuating the main blast airstream. In the present invention 10, action of the main blast air inlet valve 44 is controllable remotely, from a panel 500 and/or from the nozzle 102 of the blast hose 100 by a pilot operating the device 10. Airflow diverted from a normally-closed port 54*b* upon a main control valve-relay 54 maintains the main blast air inlet valve 44 in an open condition whereby the blast airstream is enabled to vent via the blast hose nozzle. Throughflow of the blast airstream in the pneumatic circuit is thus controllable by controlling the main blast air inlet valve 44.

In an embodiment of the present invention 10, a portion of airflow introduced into the pneumatic circuit 40 is fed upstream of the main blast air inlet valve 44 to feed the control circuit 50 which, in this embodiment, functions pneumatically, as will be explained hereinbelow.

The control circuit 50 enables remote switching between the first and second hydraulic circuits 20, 30 and cessation of the first and second hydraulic circuits 20, 30 and the pneumatic circuit 40 by remote control. Air is branched from the pneumatic circuit 40 to pneumatically control pinch valve 82, rinse control valve-relay 60, rinse water solenoid valve 34, and main blast air inlet valve 44, by manual action effected remotely at a deadman remote control handle 106, disposed at the nozzle 102 of the blast hose 100, and/or at controls disposed upon panel 500, as will be discussed hereinbelow. A pilot is therefore enabled to control cycling between a rinse cycle and a blast cycle manually remotely, and/or at the nozzle 102 of the blast hose 100, without the need of a second (or other) party to operate the pinch valve 82 or slurry shut-off valve 80 directly. The pilot may also cease blasting and rinsing altogether while maintaining pressure within the system to enable immediate resumption of blasting and/or rinsing when the deadman remote control handle 106 is re-engaged, as will be described subsequently.

Discussing now the first hydraulic circuit 20, water is drawn from fresh water supply 22, typically a water storage vessel or tank disposed in open communication with the first and second hydraulic circuits 20, 30. Water is pumped into the blast pot 24 by action of air operated double diaphragm pump 70 and piston blast pump 72. Water is thus pressurized to approximately 125 to 150 psig within blast pot 24 (alternative pressures are contemplated as within the scope of the invention). Grit, essentially non-soluble particles of varying size (most often sand-sized silicates), additional to or stored within blast pot 24, is thus conveyed under pressure in the waterflow to slurry hose 26. It should be noted that other-sized particles and materials are contemplated as within scope of the art.

Water pumped to blast pot 24 is pumped through a series of valves to prevent backflow to the water supply. Fill pump shut-off valve 84 and blast pump shut-off valve 86 are full port ball valves and serve as isolation valves enabling manual shut-off of waterflow into blast pot 24 and the first and second hydraulic circuits 20, 30 when necessary. A fill pump check valve 88 and blast pump check valve 90 prevent reverse flow of water or contaminants into the double diaphragm fill pump 70 and the piston blast pump 72 respectively. Water pumped to blast pot 24 is also metered through the grit metering valve 92 to control the outlet grit mixture volume. This maintains one-directional, regulated flow of fluid through the first hydraulic circuit 20.

Water pumped into the blast pot 24 therefore conveys grit to the slurry hose 26 under pressure at approximately 125 to 150 psig (or other pressure, so long as such pressure exceeds the pressure operative in the blast hose). Grit is thus conveyed at pressure as a slurry into the blast hose 100 via the slurry hose shut-off valve 80 and pinch valve 82. Pinch valve 82, an air-actuated sliding guillotine-style valve that controls introduction of the slurry into the blast airstream for disbursement through the blast hose 100 during blast cycle operations, is disposed in operational communication with the control circuit 50, as will be described subsequently.

The second hydraulic circuit 30 draws water downstream of piston blast pump 72 through a branch circuit bypassing the blast pot 24 to provide water absent grit for application during the rinse cycle. Water fed into the second hydraulic circuit 30 is controlled by action of rinse water solenoid valve 34, an air-actuated solenoid valve that enables on-off control of the second hydraulic circuit 30 by enabling and disabling throughflow of water therethrough. Reverse flow of water to the rinse water solenoid valve 34 is controlled by action of rinse water check valve 36 preventing backflow therethrough. The second hydraulic circuit 30 may also be shut-off by manual action at the rinse water shut-off valve 32, an isolation valve installed upstream from the rinse water solenoid valve 34 to disable waterflow through the second hydraulic circuit 30 when necessary and thereby throttle the second hydraulic circuit 30.

Blasting operations are controlled by a blast airstream instated by the pneumatic circuit 40. Air is supplied via action of compressor 42, pressurizing airflow to approximately 100 to 125 psi. Air supply is forced through main blast air inlet valve 44, main air check valve 46, and blast pressure throttling valve 48 to blast hose 100. Main blast air inlet valve 44 is an air-actuated solenoid valve providing on-off control of the main blast airstream. Main blast air inlet valve 44 engages when receiving an air pilot control signal from normally-closed port 54*b* of the main control valve-relay 54 operational within the control circuit 50, as will be described subsequently.

In the preferred embodiment set forth herein, the control circuit 50 is pneumatically operated throughout, to control diversion of airflow to effectuate valve configurations required to sustain the blast cycle, the rinse cycle, and cessation of both blast and rinse cycles. However, electrical operation to control the same valve configurations is contemplated as within scope of this invention whereby airflow of the control circuit 50 is diverted between said valve configurations by means of electrical switching, as will be described subsequently in presentation of an alternate embodiment hereinbelow.

In the preferred embodiment, then, air is fed through the control circuit 50 upstream of the main blast air inlet valve 44. This branched pneumatic circuit supplies a pilot air signal to control actuation of main blast air inlet valve 44, rinse water solenoid valve 34, rinse control valve-relay 60, and pinch valve 82, by a pilot operating the apparatus 10. Air is drawn from the pneumatic circuit 40 and routed into the control circuit 50 through instrument an air filter-regulator 52, to regulate air pressure within the control circuit 50, filter particulates, and remove moisture via an internal moisture separating spin filter and condensate drain with automatic float valve. Normal pressure within the control circuit 50 is typically set at around 75 to 100 psig. Alternative ranges of pressure are contemplated as within scope of the present invention.

Main control valve-relay 54 functions as the main on-off control for the blast air cycle and is controlled by diversion of airflow via the deadman remote control handle 106. Main control valve-relay 54 is a five-port, four-way pneumatic air pilot controlled valve with one normally-closed and one normally-open port. When the deadman remote control handle 106 is squeezed (or, in alternate embodiments contemplated as within scope of this invention, switched to an "on" position) airflow is diverted through branch circuit 50*a*, through the emergency stop valve (configured to prevent airflow therethrough when depressed by manual action thereat) and into the main control valve-relay 54. When the main control valve-relay 54 receives the air pilot signal from the deadman remote control handle, airflow is switched through normally-closed port 54*b*, thus pressurizing branch circuit 50*b*, which actuates actuator 44*a* upon the main blast air inlet valve 44, thereby enabling throughflow of air in the pneumatic circuit.

Simultaneously, air is directed in parallel through the rinse control valve-relay 60, a five-port, four-way pneumatic air pilot controlled valve having one normally-open port 60*a* and one normally-closed port 60*b*. When the remote rinse control valve 62, manually operable by the pilot, is disposed in an "off" configuration, airflow is directed through normally-open port 60*a* of the rinse control valve-relay 62 which enters pinch air block valve 58 and is exhausted when the main control valve-relay 54 is running through the normally-closed port 54*b*. Exhaustion of the pinch air block valve 58 effectuates exhaustion of air pressure from branch circuit 50*a* thereby de-actuating actuator 82*a* releasing the pinch valve 82. Thus, slurry is enabled throughflow for blasting.

The rinse cycle is enabled when remote rinse control valve 62 is switched to an "on" position. Remote rinse control valve 62 is a three-way "L" port diverter valve, with two separated fluid connections with a common center port. When the remote rinse control valve 62 is turned to the "on" position, airflow is diverted to activate actuator 60*c* which thence switches throughflow through the remote rinse control valve 62 to the normally-closed port 60*b*. Airflow then travels along branch circuit 50*b* to actuate rinse water solenoid valve 34 to enable throughflow of water through the second hydraulic circuit 30. When airflow is diverted through normally-closed port 60*b*, normally-open port 60*a* is thence closed whereby absence of pressure deactivates pinch air block valve 58, causing closure thereat. When the pinch air block valve 58 is closed, pressure in branch circuit 50*a* is maintained, actuator 82*a* is actuated, and pinch valve 82 is thereby engaged to prevent throughflow of slurry into the blast hose.

Figure 2:
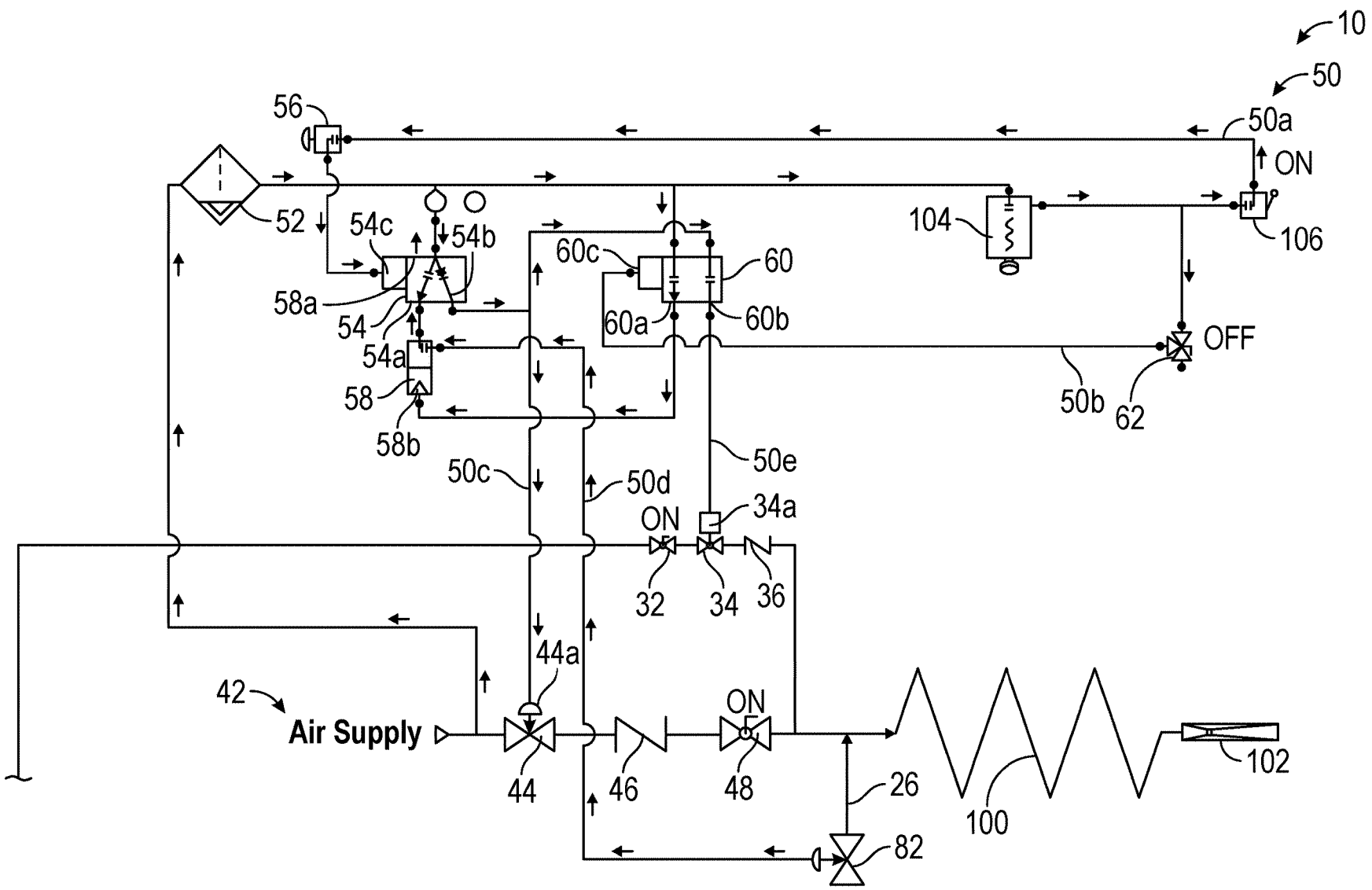
FIG. 2 is a schematic view of a control circuit disposed to actuate a blast cycle.

Referring particularly now to FIG. 2, an overview of the control circuit 50 in a blast configuration will be described. In the blast configuration, the first hydraulic circuit 20 is operative and the pneumatic circuit 40 is operative whereby slurry is produced at pressure for surface scouring operations. The second hydraulic circuit 30 is ceased at rinse water solenoid valve 34.

As shown specifically in FIG. 2, air is drawn upstream of the main blast air inlet valve 44 and fed through air filter-regulator 52 to maintain pilot signal pressure of approximately 75 to 100 psig. Alternative pressures are contemplated as within scope of the invention. Air is passed through deadman regulator 104 to deadman remote control handle 106. Because the deadman remote control handle 106 is engaged (or switched to an "on" position in alternate embodiments contemplated consistent with this invention), airflow is diverted diagrammatically north (see FIG. 2) into control branch circuit 50*a*. Airflow in branch circuit 50*a* flows through emergency stop valve 56 and instates switching of airflow through normally-closed port 54*b* in the main control valve-relay 54 by actuating actuator 54*c*. Airflow is thus diverted into branch circuit 50*c* which, diverted diagrammatically south (see FIG. 2) instates actuator 44*a* and opens main blast air inlet valve 44 thereby enabling throughflow of the blast airstream in the pneumatic circuit 40. Airflow diverted north in branch circuit 50*c* (see FIG. 2) is arrested at the rinse control valve relay 60 normally-closed port 60*b*, which is closed.

Simultaneously, air coming from the air filter-regulator 52 is drawn in parallel through rinse control valve-relay 60 normally-open port 60*a*, thereby engaging pinch air block valve 58, which opens. Since airflow through the main control valve-relay 54 is being directed through normally-closed port 54*b*, airflow into the pinch air block valve 58 is exhausted through pinch valve exhaust 58*a*, which pinch valve exhaust 58*a* is otherwise shut off when airflow through the main control valve-relay 54 is operating through the normally-open port 54*a*. Air is thus exhausted from branch circuit 50*d* whereby actuator 82*a* is de-actuated and pinch valve 82 is rendered open.

Because remote rinse control valve is in the "off" position, airflow directed diagrammatically south (see FIG. 2) upstream of the deadman remote control handle 106 is prevented from pressurizing rinse control valve-relay 60 via branch circuit 50*b* to switch airflow through normally-closed port 60*b*. Therefore, rinse water solenoid valve 34 is disengaged and throughflow of water through the second hydraulic circuit 30 is prevented. Thus, the blast cycle is operative; the first hydraulic curcuit 20 and the pneumatic circuit 40 enable blasting of slurry at pressure for surface cleaning and scouring operations.

Figure 3:
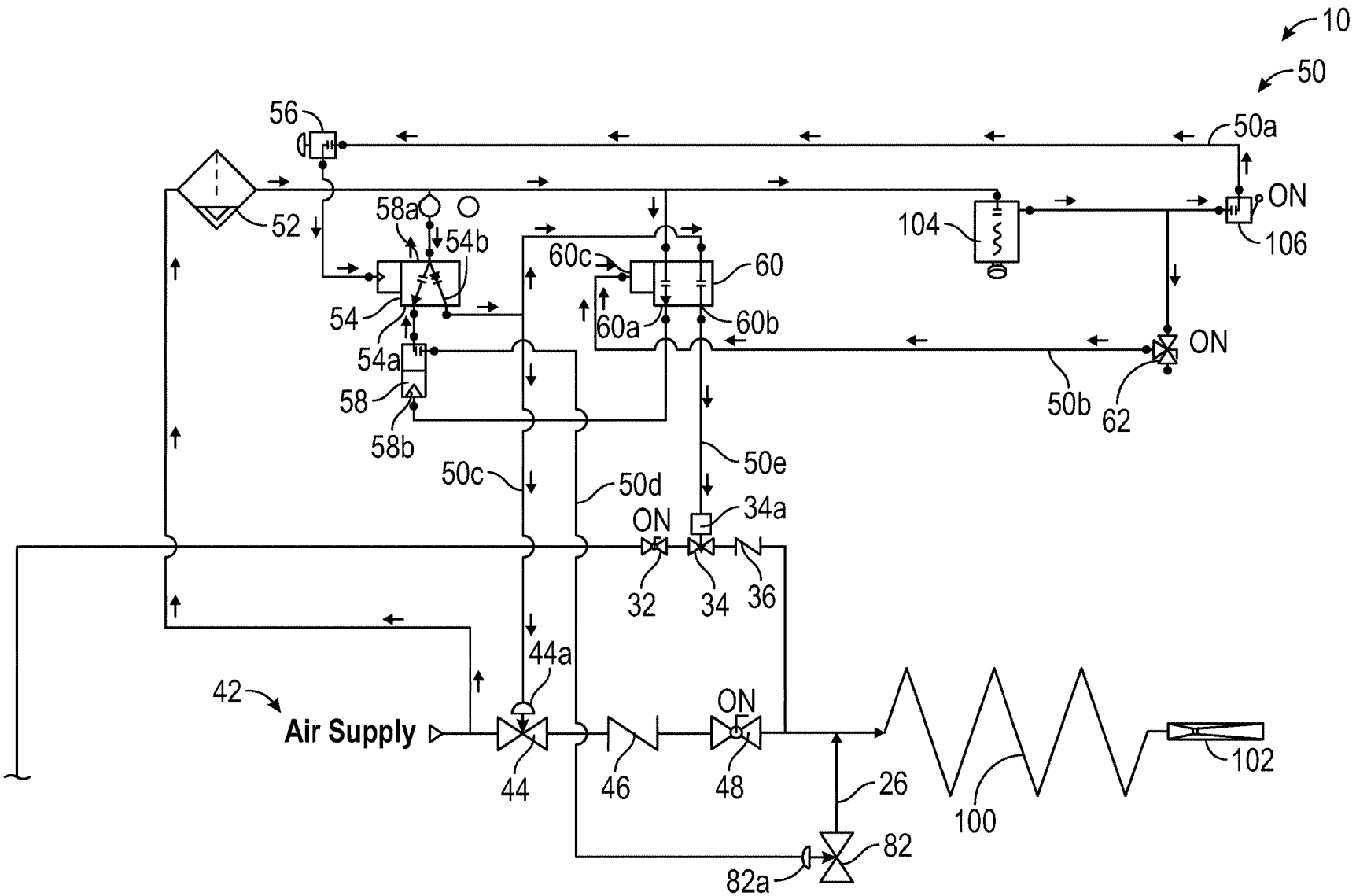
FIG. 3 is a schematic view of the control circuit disposed to actuate a rinse cycle.

Discussing now FIG. 3, a configuration of the control circuit 50 in a rinse cycle configuration will now be described.

In the rinse cycle, the control air pilot signal is configured to engage pinch valve 82, maintain main blast air inlet valve 44 open, and maintain rinse water solenoid valve 34 open. Airflow is again directed upstream of main blast air inlet valve 44 into the control circuit 50 as set forth above in the previous description of FIG. 2. Airflow passes through air filter-regulator 52, as previously described, and pressure is stepped down to approximately 75 to 100 psig. (Alternative pressures are contemplated as within scope of the invention.) In the rinse configuration, the deadman remote control handle 106 is squeezed (or disposed in the "on" position) enabling airflow diagrammatically north into branch circuit 50*a* (see FIG. 3). However, to instate the rinse cycle, the pilot engages the remote rinse control valve 62 to the "on" position. Airflow directed diagrammatically south (see FIG. 3) into the remote rinse control valve 62 is enabled passage therethrough, and thus flows through branch circuit 50*b* to actuate switching of airflow through rinse control valve-relay 60 by opening normally-closed port 60*b* and closing normally-open port 60*a*. As a result, airflow through rinse control valve-relay 60 ceases through normally-open port 60*a*, thereby disengaging pinch air block valve 58, which therefore reverts to a closed position. This seals off branch circuit 50*d*, and maintains pressure therein, whereby actuator 82*a* remains actuated and pinch valve 82 is therefore maintained closed effectively ceasing throughflow within the first hydraulic circuit 20.

Because airflow through main control valve-relay 54 is operative through normally-closed port 54, air flows diagrammatically south (see FIG. 3) within branch circuit 50*c* to actuate actuator 44*a*, thereby allowing airflow within the pneumatic circuit 40. Concurrently, air flows diagrammatically north (see FIG. 3) to the rinse control valve-relay, currently disposed with normally-closed port 60*b* now open, whereby airflow is directed down branch circuit 50*e* to actuate rinse water solenoid valve 34 whereby waterflow through the second hydraulic circuit 30 is enabled. The rinse cycle is thereby ii enabled as water, flowing through the second hydraulic circuit 30, is fed to the blast hose and ejected via the blast airstream through the pneumatic circuit 40 without introduction of slurry, which is maintained at the pinch valve 82. Switching between blast and rinse cycles, therefore, is as simple as moving the remote rinse control valve 62 between respective "on" and "off" positions, and may therefore by effected without disabling the compressor 42, or pumps 70, 72. Further, no need of throttling the slurry hose is required as the air pilot signal is automatically routed to activate pinch valve 82, and rinse water solenoid valve 34, while maintaining blasting operations by continuing to activate main blast air inlet valve 44.

Figure 4:
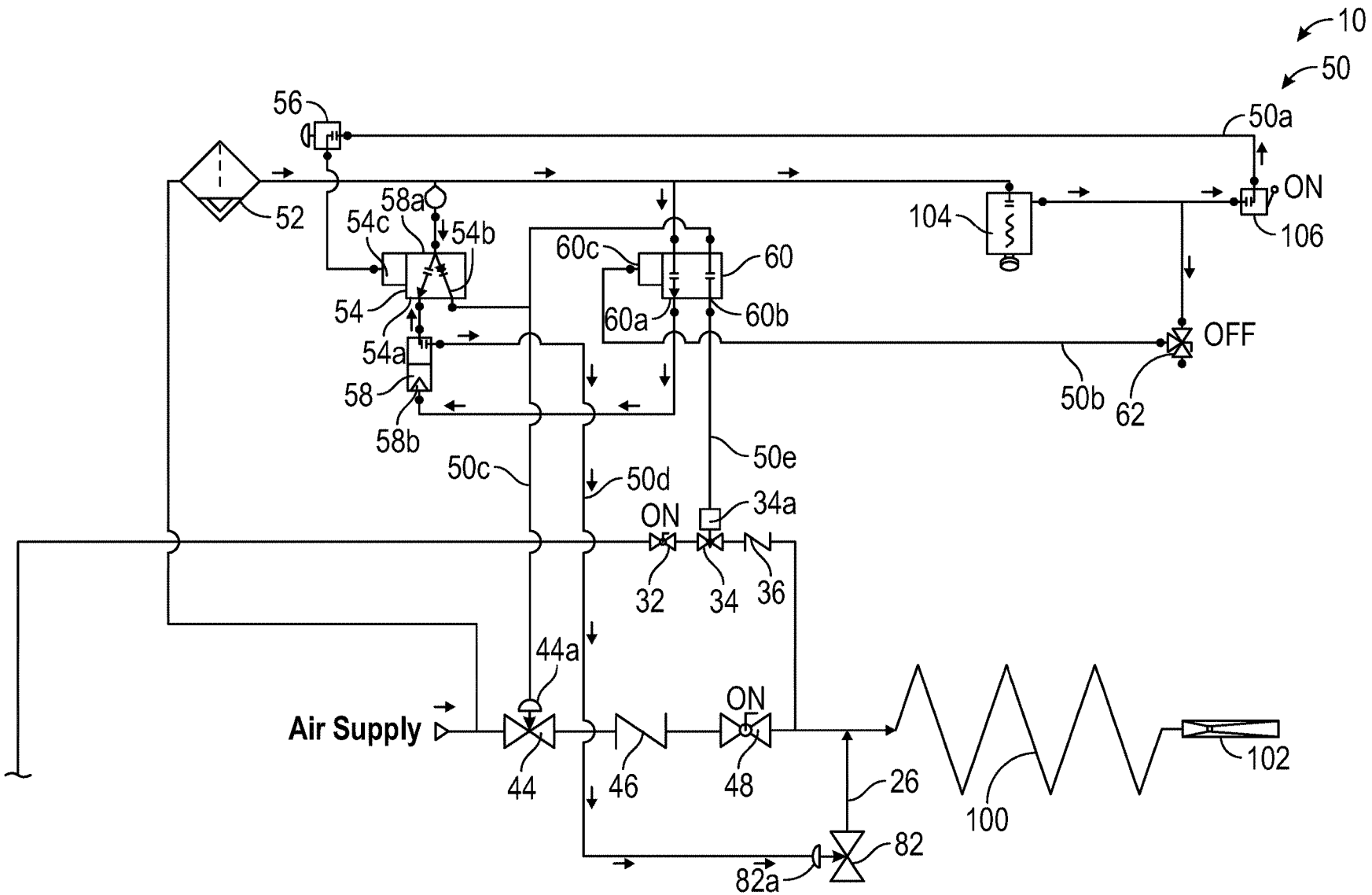
FIG. 4 is a schematic view of the control circuit disposed to in an "off" configuration.

Discussing now FIG. 4, the control circuit 50 in an off configuration will now be described.

When deadman remote control handle 106 is released (or otherwise switched to an "off" configuration) airflow within branch circuit 50*a* is ceased. Resultantly, pressure at the main control valve-relay 54 reverts airflow to normally-open port 54*a*, directing airflow into branch circuit 50*d* to actuate actuator 82*a* which engages pinch valve 82 thereby sealing off the first hydraulic curcuit 20 at the slurry hose 26. Since the remote rinse control valve 62 is disposed in the "off" configuration, airflow is prevented from action interior to branch circuit 50*b*, whereby airflow through rinse control valve-relay 60 reverts to normally-open port 60*a*. This configuration therefore prevents airflow into branch circuit 50*c*, thereby preventing actuation of rinse water solenoid valve 34 whereby the second hydraulic circuit 30 is impeded. Airflow is thus directed via normally-open port 60*a* to the pinch air block valve 58, which is caused to open. Because airflow from the main control valve-relay 54 is active through the normally-open port 54*a*, airflow through the pinch air block valve 58 is not exhausted but, instead, diverted into branch circuit 50*d*, thereby actuating actuator 82*a* and pinch valve 82. Since airflow through normally-closed port 54*b* is likewise prevented, airflow is preempted from branch circuit 50*c* whereby actuator 44*a* is de-actuated and the main blast air inlet valve 44 is rendered closed. Thus, all circuits 20, 30, and 40, are effectively ceased when a pilot releases the deadman remote control handle 106 (or otherwise switches it to an "off" position). It should be noted, however, that pumps 70, 72 and compressor 42 are still active whereby engagement of the deadman remote control handle 106 may immediately start up blasting operations again.

The emergency stop valve 56 enables emergency cessation of blast operations. The emergency stop valve 56 is a normally-open valve when positioned in the "run" position. Depression of a detent effectuates closure off the valve 56 and isolates air returning from the deadman remote control handle 106 to prevent pressurizing the actuator 54*c* on the main control valve-relay 54. Simultaneously, air is exhausted from the emergency stop valve 56 to the main control valve-relay 60, which causes the main control valve-relay 60 to disengage, preventing the air signal to main blast air inlet valve 44 and thereby ceasing blast operations.

Figure 5:
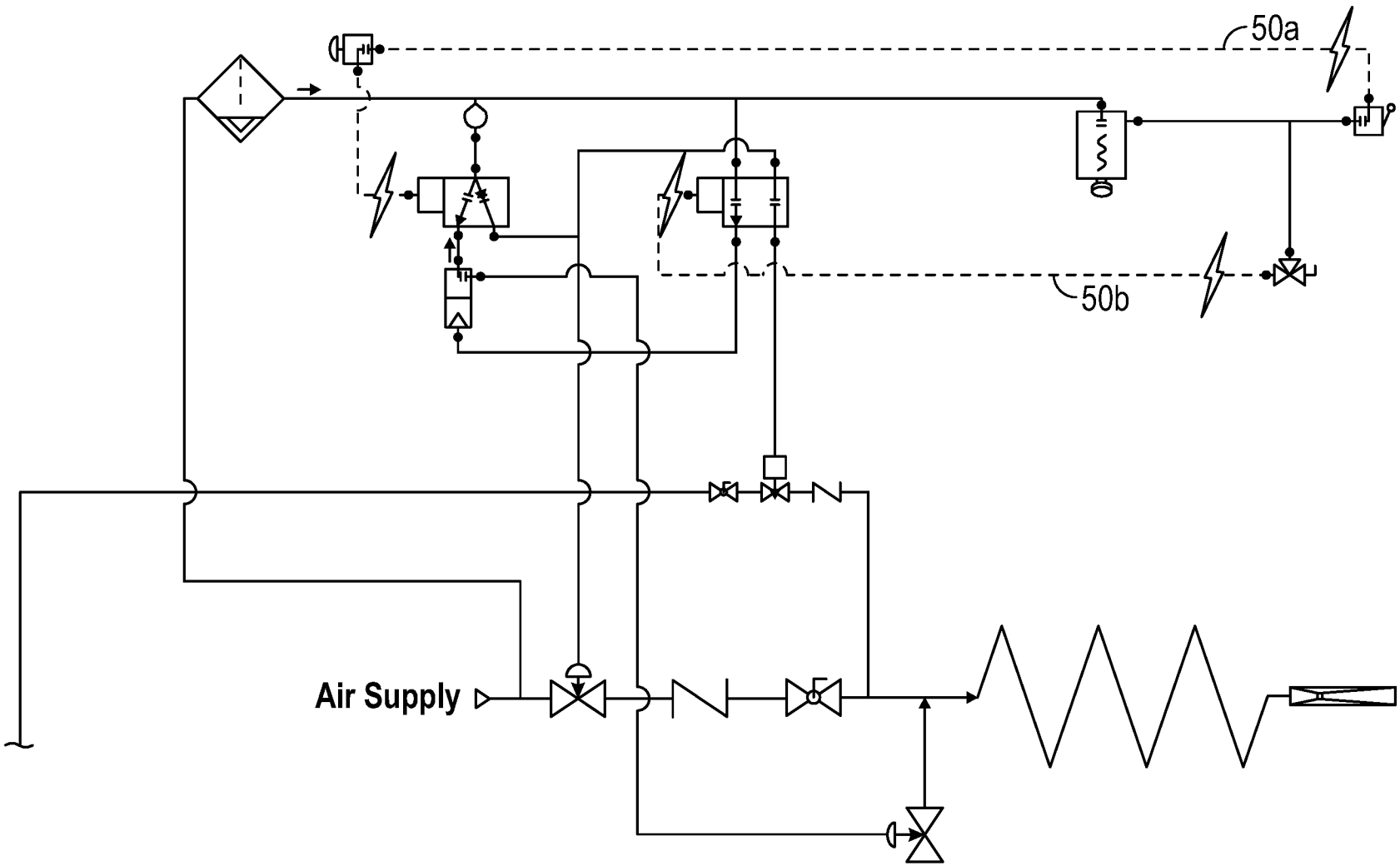
FIG. 5 is a schematic view of an alternate embodiment utilizing an electrical control circuit.

As shown in FIG. 5, an alternate embodiment utilizing electrical means of controlling the main control valve-relay 54 and the rinse control valve-relay 60 is contemplated.

In this alternate embodiment, branch circuits 50*a* and 50*b* are essentially rendered via electrical circuits and switches in lieu of directed airflow pressurizing to actuators 54*c*, 60*c* to switch configurations of normally-open ports 54*a*, 60*a*, and normally-closed ports 54*b*, 60*b*. In such an embodiment, however, the remaining components of the control circuit 50 are substantially similar, and the first hydraulic circuit 20, the second hydraulic circuit 30, and the pneumatic circuit 40 remain the same.

In this alternate embodiment, switching is effected electrically. Thus, when the deadman remote control handle 106 is actuated, a contact (not shown) enables conduction of current in now-electric branch circuit 50*a* to switch airflow interior to the main control valve-relay 54. Likewise, when the remote rinse control valve-relay 62 is moved to the "on" position, contacts (not shown) enable conduction of current through now-electric branch circuit 50*b* to effect switching of airflow through normally-closed port 60*b* interior to the rinse control valve-relay 60.

Figure 6:
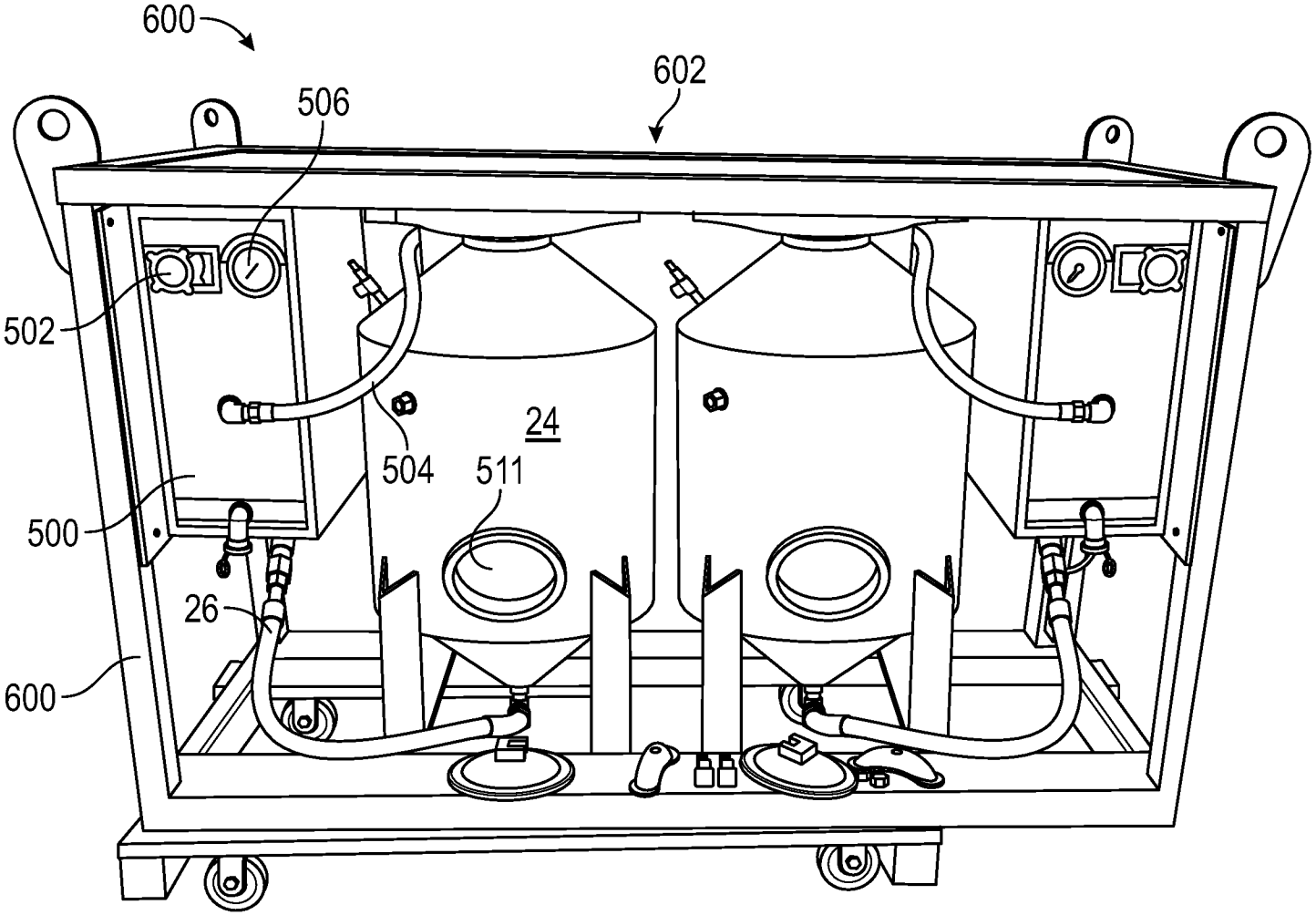
FIG. 6 is a rear elevation view of an example embodiment.

FIG. 6 illustrates a rear elevation view of an example embodiment of the present improved wet abrasive blast machine with remote control rinse cycle reduced to practice. In this example embodiment, dual systems are disposed in tandem mounted side-by-side to frame member 600. For convenience and clarity of enumeration, only one of the dual systems will be described herein, however it is to be understood that like parts identified in the drawings with like reference characters are therefore described in all instances, even when referred to in the singular.

Blast pot 24 is disposed mounted to frame member 600 to enable portability of the present embodiment. Funnel top member 602 enables filling of blast pot 24 with grit (shown in greater detail in, and discussed hereinbelow with reference to, FIG. 12). Aperture 511 enable access to blast pot 24 interior for blast pot cleanout. Inlet panel 500 (shown in greater detail in FIG. 8) includes connection port 502 for the main blast air inlet valve 44. Fill line 504 carries water from the high-volume, low pressure double diaphragm fill pump 70, disposed behind inlet panel 500, to fill blast pot 24 (see FIG. 10). Blast inlet pressure gauge 504 shows active pressure at the main blast air inlet valve 44 from supply air when connection port 502 is interconnected with a compressor (not shown) and air is conveyed to the main blast air inlet valve 44. Air dump valve control 509 enables depressurization of the supply-side before disconnecting the compressor (not shown) from the connection port 502 to main blast air inlet valve 44.

Figure 7:
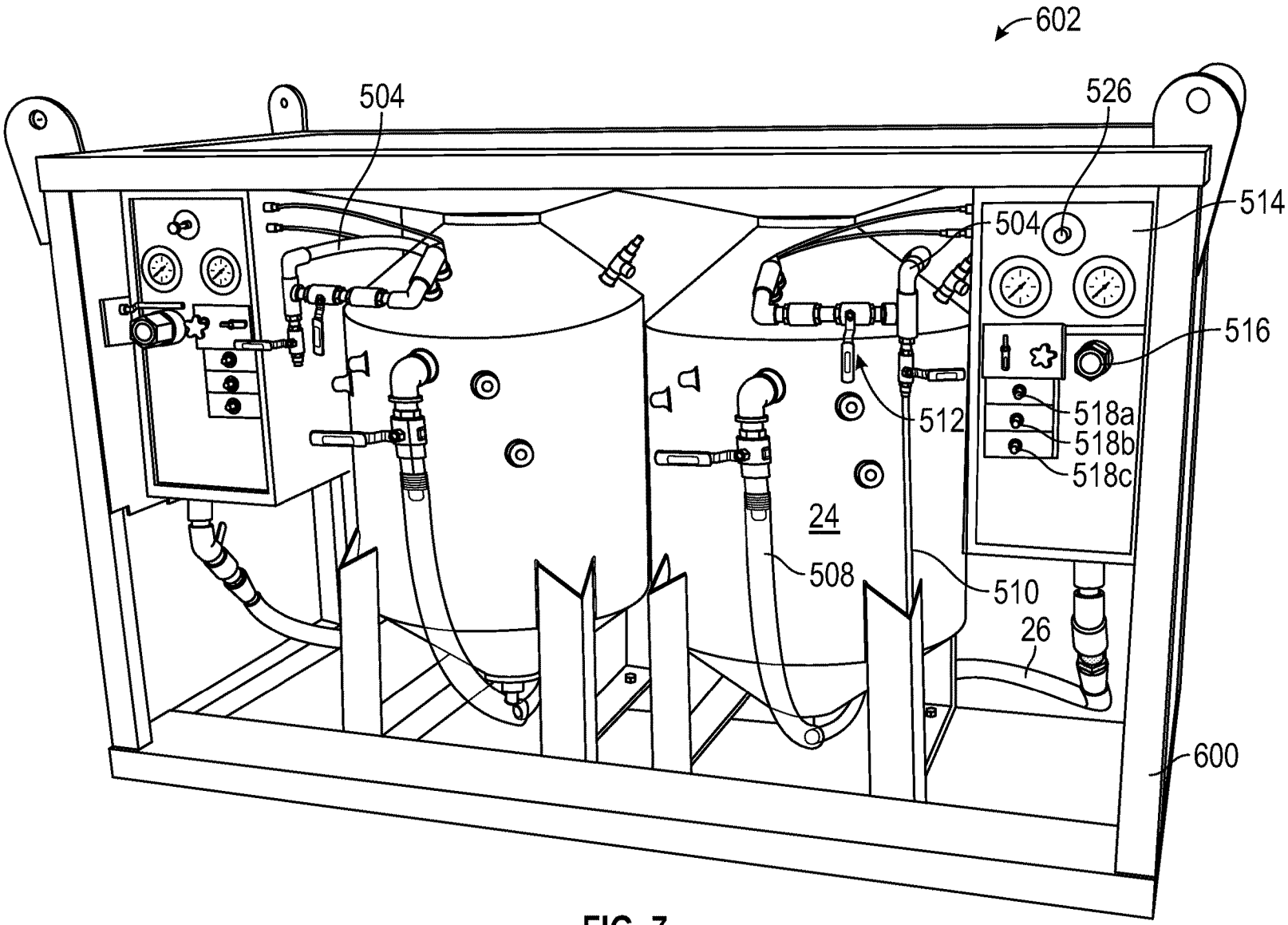
FIG. 7 is a front elevation view of the example embodiment.
Figure 8:
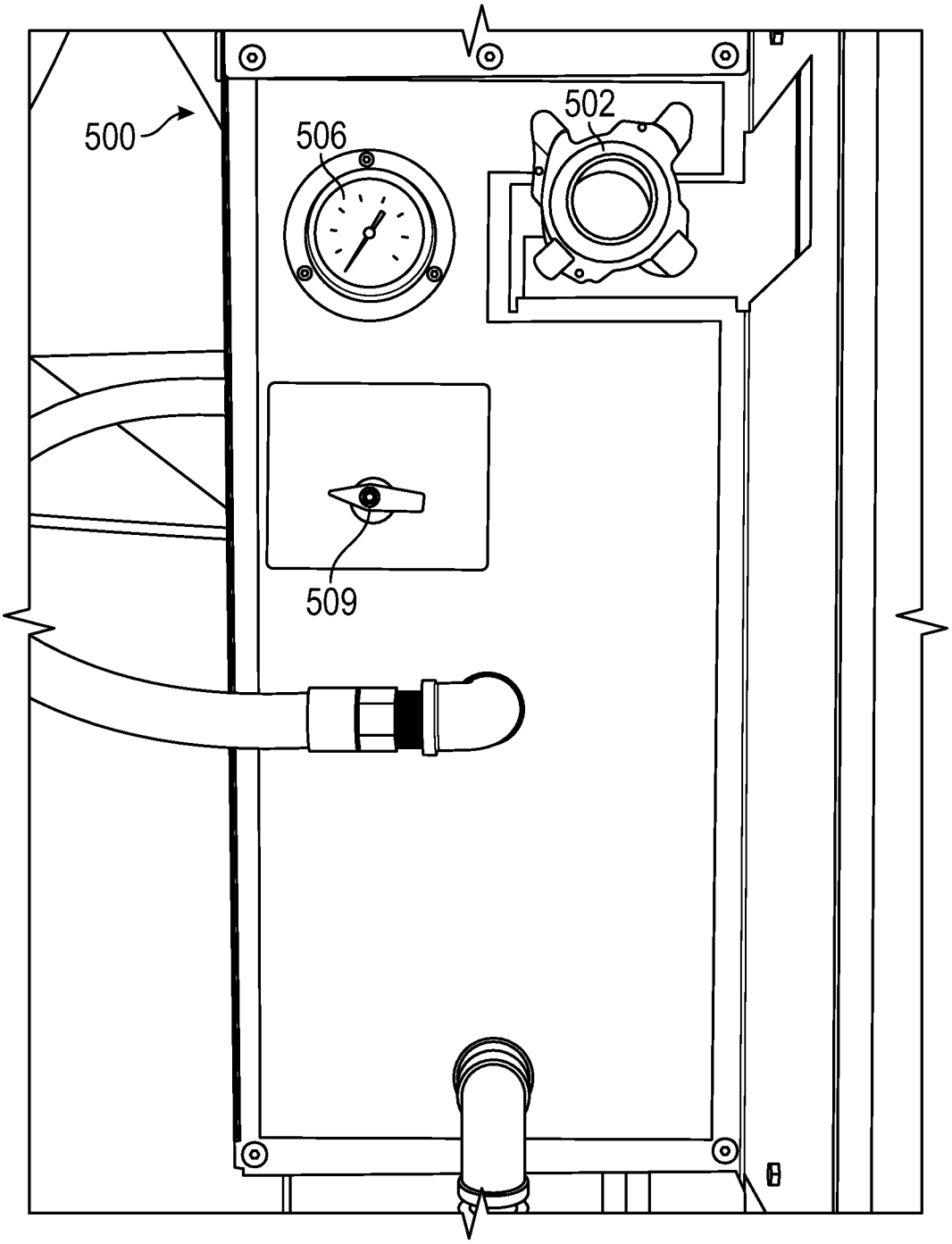
FIG. 8 is a detail view of an inlet panel disposed upon the rear of the example embodiment illustrating in FIG. 6.
Figure 9:
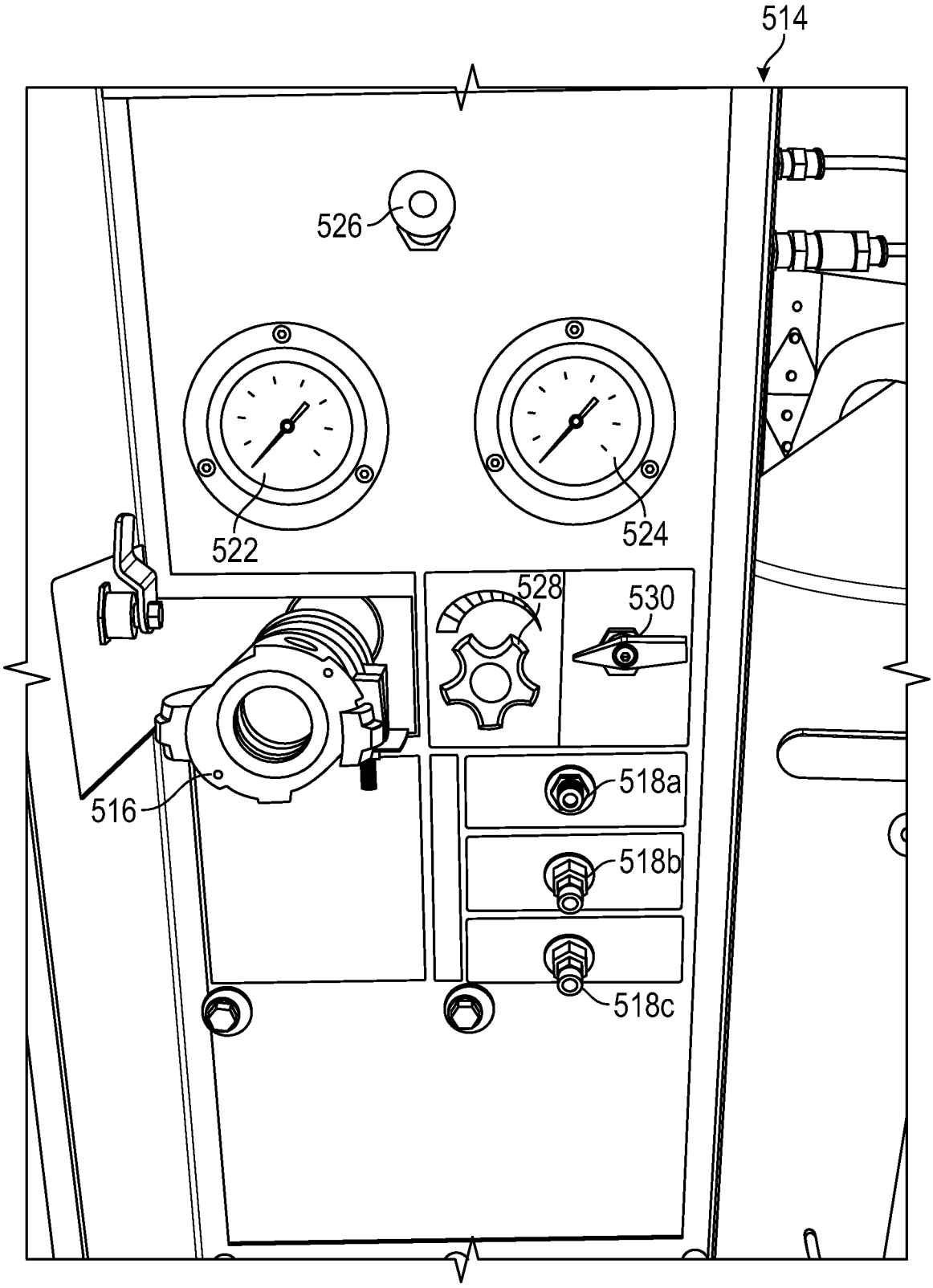
FIG. 9 is a detail view of an outlet panel disposed upon the front of the example embodiment illustrated in FIG. 7.

FIG. 7 illustrates a front elevation view of the example embodiment shown in FIG. 6. Dump valve 508 enables manual emptying of blast pot 24. Utility line 510 draws water from the water source (not shown) for manual release and use (such as when washing hands, for example) at faucet 512. Outlet panel 514 (shown in greater detail in, FIG. 9) includes blast hose attachment aperture 516 for interconnection of the blast hose 100. Pneumatic control line ports 518*a*, 518*b*, and 518*c* enable interconnection with pneumatic lines 520*a*, 520*b*, and 520*c*, respectively, enabling relay of the air pilot control signal from the deadman remote control handle 100 to instantiate the control circuit 50, as will be described subsequently (see FIG. 11) to activate and deactivate the rinse control valve-relay 60 to engage the rinse cycle when the remote rinse control valve 62 is opened.

Blast pressure gauge 522 shows pressure in the blast stream and hopper pressure gauge 524 shows the pressure inside blast pot 24. Emergency stop button 526 activates emergency stop valve 56 to disable blast operations when engaged. Control 528 enables manual control of grit metering valve 92 to selectively control concentration of grit entering slurry hose 26. Blast pump switch 530 enables immediate manual deactivation of blast pump 72.

Figure 10:
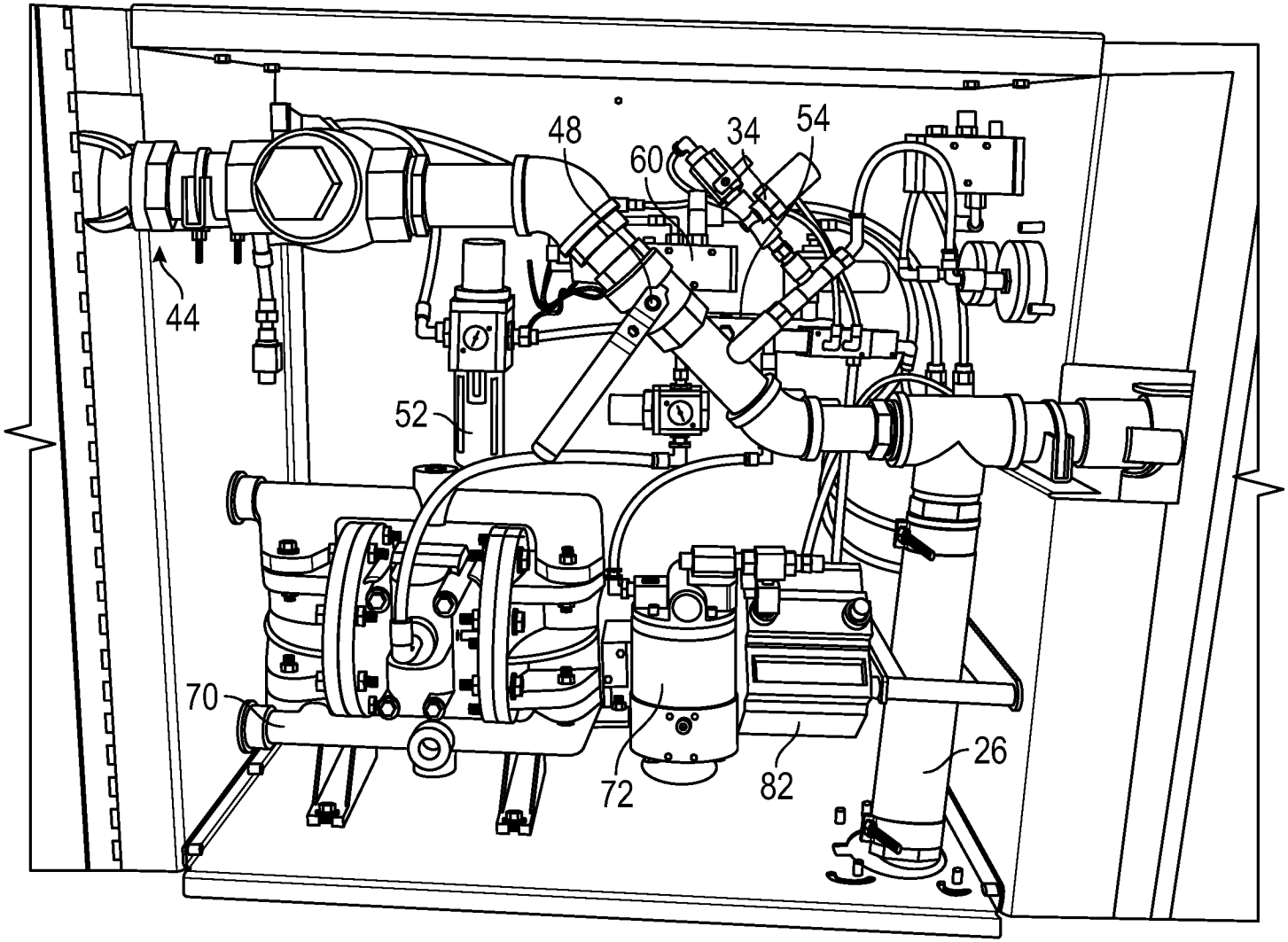
FIG. 10 is a detail view of the internal components disposed between the panels illustrated in FIGS. 8 and 9.

FIG. 10 is a detailed view of the internal components disposed between the inlet panel 500 and the outlet panel 514.

High volume, low pressure, double diaphragm fill pump 70 feeds water from the supply (not shown) to blast pot 24 via water fill line 504. Low volume high pressure piston blast pump 72 pressurizes blast pot 24 for introduction of slurry into the slurry hose 26. Pinch valve 82 operates guillotine-style valve to pinch slurry hose 26 and cease throughflow of slurry in the first hydraulic curcuit 20 in response to air pilot signal via control circuit 50*d* (see FIGS. 2, 3, and 4). Rinse water solenoid valve 34 introduces rinse water when the second hydraulic circuit 30 is activated (see FIG. 3). Air is fed to the control circuit 50 through control circuit air inlet tubing 532 connected to the main blast air inlet valve 44. Air passes through air filter-regulator 52 and is fed to the main control valve-relay 54 and rinse control valve-relay 60.

Figure 11:
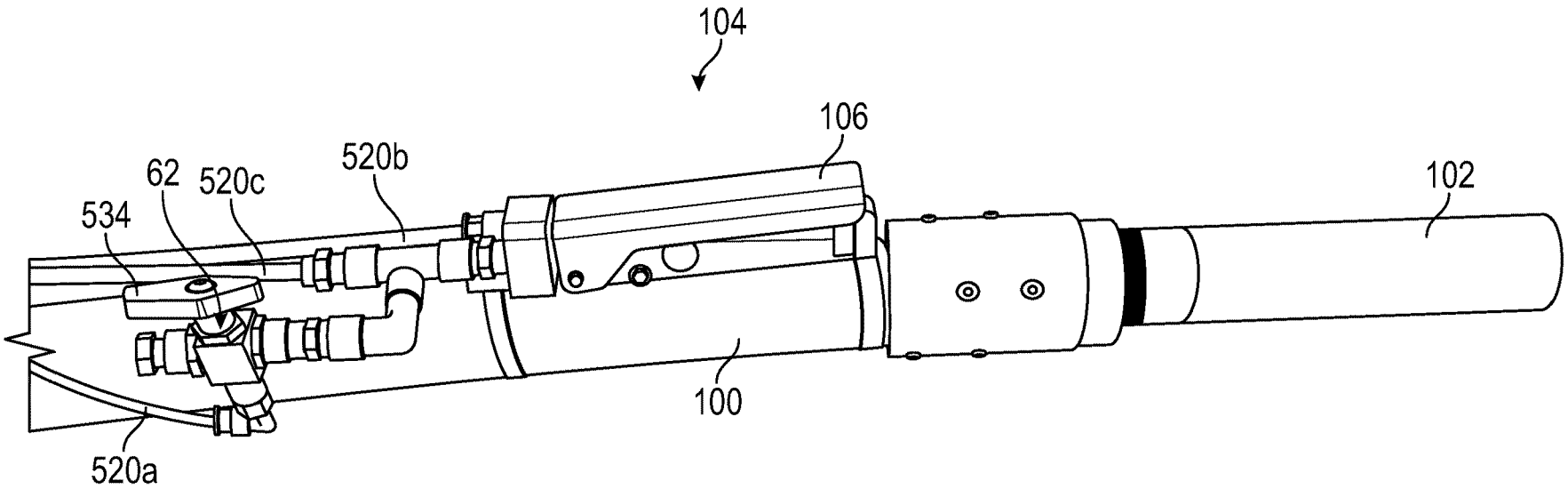
FIG. 11 is a detailed view of a blast hose nozzle with deadman remote control handle.

FIG. 11 illustrates a detail view of the blast hose 100 nozzle 102 and deadman remote control handle 106. Pneumatic control line 520*b* brings air pilot signal supply to deadman remote control handle 106. Depression of deadman remote control handle 106 enables flow of supply air pilot control signal to flow through control branch circuit 50*a* (see FIGS. 2 and 3) via pneumatic control line 520*c* (the return line) and thereby maintain actuation of actuator 44*a* controlling the blast airstream. Pneumatic control line 520*a* enables passage of air pilot control signal into control branch circuit 50*b* to actuate actuator 60*c*, and thereby initiate actuator 34*a* controlling the rinse water solenoid valve 34, when remote rinse control valve switch 534 is turned to an "ON" position, thereby diverting airflow through remote control rinse valve 62 (see FIG. 3). In alternate embodiments of the invention set forth herein, pneumatic control lines 520*a*, 520*b*, and 520*c* may by electrical lines disposed in circuit to effectuate switching of the relevant valves 60 and 54 electrically to manipulate the air pilot control signal to same effect (see FIG. 5).

Figure 12:
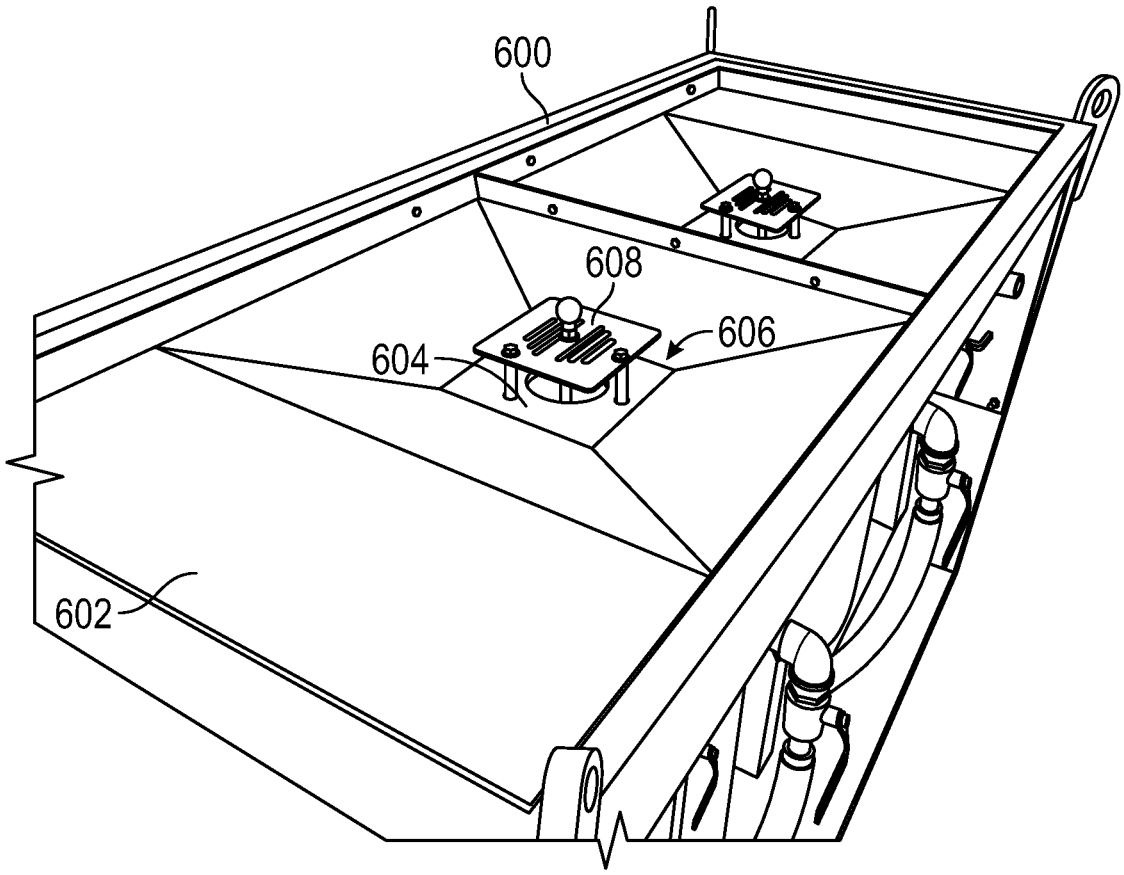
FIG. 12 is an elevation view of a top of the example embodiment illustrated in to FIG. 6.

FIG. 12 illustrates an elevation view of the funnel top member 602, integrated into frame member 600, enabling easy fill of blast pot 24 with grit. Grit loaded into the funnel top member 602 falls, under the influence of gravity, under raised cover plate 608, through top aperture 604, interior to blast pot 24. Top aperture 604 includes a seating stopper 606 disposed to plug said top aperture 604 from the interior of blast pot 24 when a water level forces said stopper 606 via the buoyancy force to seat into said top aperture 604. Further, pressure instantiated interior to blast pot 24 likewise maintains the seating stopper 606 in position sealing the said top aperture 604. Seating stopper 606, therefore, releases closure of the top aperture 604 when both the water level interior to the blast pot 24 is below a certain level (corresponding to a height of the seating stopper) and the pressure in the blast pot is equal to or lesser than atmospheric pressure.

What is claimed is:

1. An improved wet abrasive blast machine with remote control rinse cycle enabling remote control of blasting operations between a rinse cycle and a blast cycle, said improved wet abrasive blast machine comprising:

a first hydraulic circuit communicating waterflow to a blast pot, a slurry hose, and a blast hose;

a second hydraulic circuit communicating waterflow to the blast hose to bypassing the blast pot and the slurry hose;

a pneumatic circuit communicating outflow of air through the blast hose; and a control circuit comprising an air pilot signal directable to enable remote switching between the first and second hydraulic circuits and to cease operations of said first and second hydraulic circuits and operation of the pneumatic circuit without deactivating action of at least one pump pressurizing said first and second hydraulic circuits nor action of a compressor feeding air to the pneumatic circuit;

wherein immediate cycling between a rinse cycle and a blast cycle is controllable remotely, and by a pilot operating said blast hose, to rapidly switch between blasting and rinsing operations when actively engaged in surface cleaning.

2. The improved wet abrasive blast machine with remote control rinse cycle of claim 1 wherein the air pilot signal is fed from airflow introduced into the pneumatic circuit upstream of a main blast air inlet valve.

3. The improved wet abrasive blast machine with remote control rinse cycle of claim 2 wherein the pilot air signal is configurable as airflow to pressurize and depressurize each of a plurality of actuators, said plurality of actuators comprising:

an actuator disposed actuating the main blast air inlet valve configured in operational communication within the pneumatic circuit, said actuator opening the main blast air inlet valve when pressurized by incident airflow;

an actuator disposed actuating a pinch valve upon the slurry hose configured in operational communication within the first hydraulic is circuit, said actuator closing the pinch valve when pressurized by incident airflow;

an actuator actuating a pinch air block valve configured in operational communication within the control circuit, said actuator opening said pinch air block valve when pressurized by incident airflow; and an actuator actuating a rinse solenoid valve configured in operational communication with the second hydraulic circuit, said actuator opening said rinse solenoid valve when pressurized by incident airflow.

4. The improved wet abrasive blast machine with remote control rinse cycle of claim 3 wherein the air pilot signal is further configurable to control switching between:

at least one normally-open port and at least one normally-closed port interior to a main control valve-relay configured in operational communication in the control circuit; and at least one normally-open and at least one normally-closed port interior to a rinse control valve-relay configured in operational communication within the control circuit.

5. The improved wet abrasive blast machine with remote control rinse cycle of claim 4 wherein airflow directed through the normally-open port in the main control is valve-relay feeds a branch circuit to pressurize the actuator controlling the pinch valve and thereby cease throughflow of slurry to the blast hose.

6. The improved wet abrasive blast machine with remote control rinse cycle of claim 5 wherein airflow directed through the normally-open port in the rinse control valve-relay feeds a branch circuit that pressurizes the actuator actuating the pinch air block valve, whereby the pinch air block valve is opened.

7. The improved wet abrasive blast machine with remote control rinse cycle of claim 6 wherein airflow through the pinch air block valve is merged into the branch circuit pressurizing the actuator controlling the pinch valve when airflow is concurrent through the normally-open port in the main control valve-relay.

8. The improved wet abrasive blast machine with remote control rinse cycle of claim 7 wherein airflow directed through the normally-closed port in the main control valve-relay feeds a branch circuit that pressurizes the actuator actuating the main blast air inlet valve and concurrently sends an air pilot signal to the normally-closed port of the rinse control valve-relay.

9. The improved wet abrasive blast machine with remote control rinse cycle of claim 8 wherein the control circuit further comprises a remote rinse control valve operable between an "off" position and an "on" position, whereby movement of the remote rinse control valve to the "on" position diverts airflow into a branch circuit to switch airflow within the rinse control valve-relay from the normally-open port to the normally-closed port whereby airflow is directable to pressurize the actuator actuating the rinse water solenoid valve and enable waterflow through the second hydraulic circuit.

10. The improved wet abrasive blast machine with remote control rinse cycle of claim 9 wherein airflow directed through the normally-closed port of the main control valve-relay and the normally-open port in the rinse control valve-relay concurrently actuates the pinch air block valve to open and wherein the pinch valve is released via exhaustion through a pinch valve exhaust, which pinch valve exhaust is otherwise closed when airflow through the main control valve-relay is configured through the main control valve-relay's normally-open port.

11. The improved wet abrasive blast machine with remote control rinse cycle of claim 10 wherein the pinch air block valve maintains pressure within the branch circuit controlling actuation of the pinch valve when said pinch air block valve is closed whereby the pinch valve is maintained closed.

12. The improved wet abrasive blast machine with remote control rinse cycle of claim 11 wherein manual action at a deadman remote control handle disposed upon a nozzle of the blast hose feeds a branch circuit that pressurizes the actuator controlling airflow through the normally-closed port of the main control valve-relay whereby manual control of the remote rinse control valve between the "on" and "off" positions therefore switches airflow through the rinse control valve-relay to control waterflow through the second hydraulic circuit and the first hydraulic circuit while maintaining operation of the pneumatic circuit.

13. The improved wet abrasive blast machine with remote control rinse cycle of claim 12 wherein release of the deadman remote control handle prevents airflow from the branch circuit pressurizing the actuator of the main control valve-relay wherein airflow reverts to the normally-open port therein, thereby ceasing pressurization of the actuator actuating the main blast air inlet valve and disabling the pneumatic circuit, whereby airflow pressurizes the actuator actuating the pinch valve to disable the first hydraulic circuit.

14. The improved wet abrasive blast machine with remote rinse cycle of claim 4 wherein switching airflow between the normally-open and normally-closed ports interior to both the main control valve-relay and the normally-open and normally-closed ports interior to the rinse control valve-relay is effectuated electrically instead of pneumatically.

* * * * *